US007814576B2

(12) United States Patent
Nakazawa

(10) Patent No.: US 7,814,576 B2
(45) Date of Patent: Oct. 19, 2010

(54) TIGHTS

(75) Inventor: Susumu Nakazawa, Tokyo-To (JP)

(73) Assignee: Yugen Kaisha Nakazawa Kenkyushitsu, Tokyo-To (JP)

( * ) Notice: Subject to any disclaimer, the term of this patent is extended or adjusted under 35 U.S.C. 154(b) by 483 days.

(21) Appl. No.: 11/791,765

(22) PCT Filed: Jan. 11, 2006

(86) PCT No.: PCT/JP2006/300202

§ 371 (c)(1),
(2), (4) Date: May 29, 2007

(87) PCT Pub. No.: WO2006/080190

PCT Pub. Date: Aug. 3, 2006

(65) Prior Publication Data

US 2008/0120757 A1 May 29, 2008

(30) Foreign Application Priority Data

Jan. 26, 2005 (JP) ..... 2005-018316

(51) Int. Cl.
*A41D 1/08* (2006.01)

(52) U.S. Cl. ..... 2/227

(58) Field of Classification Search ..... 2/401, 2/406, 407, 242, 69, 227, 228; 66/178 R; 450/99, 100, 109, 107, 122, 123, 132
See application file for complete search history.

(56) References Cited

U.S. PATENT DOCUMENTS 3,338,776 A * 8/1967 Blair ..... 428/88

(Continued)

FOREIGN PATENT DOCUMENTS

JP 11-061516 3/1999

(Continued)

OTHER PUBLICATIONS

International Preliminary Report on Patentability mailed Jan. 24, 2008 for International Application No. PCT/JP2006/300202.

*Primary Examiner*—Alissa L Hoey
(74) *Attorney, Agent, or Firm*—Wenderoth, Lind & Ponack, L.L.P.

(57) ABSTRACT

A pair of tights restrains the knees from wobbling motions, stabilize running motions, and can be comfortably worn for a long time without causing fatigue. The pair of tights includes front parts for covering the front side of the body between the waistline and the front sides of the ankles, back parts for covering the back side of the body between the waist and the back sides of the ankles, outer side parts each covering a side region between the greater trochanter and the outer side of the ankle, back waist projections each formed integrally with the outer side part and projecting from the upper end of the outer side part over the back side of the waist, inner side parts each covering a region between the crotch and the inner side of the ankle, outer knee support parts for supporting the outer side of the knee, inner knee support parts each for supporting the inner side of the knee, and sartorius and adductors support parts each covering the back side of the waist, the sartorius and the adductors, and extending to the upper end of the inner knee support part. The outer side parts, the back waist projections, and the outer and inner support parts are formed of a stretchable material having a high elastic modulus higher than that of a material forming the rest.

5 Claims, 4 Drawing Sheets

U.S. PATENT DOCUMENTS

| | | | | |
|---|---|---|---|---|
| 4,089,064 | A * | 5/1978 | Chandler, Jr. | 2/78.2 |
| 4,625,336 | A * | 12/1986 | Derderian | 2/79 |
| 4,862,523 | A * | 9/1989 | Lipov | 2/409 |
| 5,109,546 | A * | 5/1992 | Dicker | 2/70 |
| 5,367,708 | A * | 11/1994 | Fujimoto | 2/22 |
| 6,176,816 | B1 * | 1/2001 | Dicker et al. | 482/124 |
| 6,186,970 | B1 * | 2/2001 | Fujii et al. | 602/75 |
| 6,430,752 | B1 * | 8/2002 | Bay | 2/228 |
| 6,446,264 | B2 * | 9/2002 | Fairhurst et al. | 2/69 |
| 6,874,337 | B2 * | 4/2005 | Uno et al. | 66/177 |
| D507,857 | S * | 8/2005 | Ota et al. | D2/742 |
| D508,304 | S * | 8/2005 | Ota et al. | D2/742 |
| 7,074,204 | B2 * | 7/2006 | Fujii et al. | 602/75 |
| 7,229,390 | B2 * | 6/2007 | Fujii et al. | 482/124 |
| 7,516,498 | B2 * | 4/2009 | Torry | 2/69 |
| 7,559,093 | B2 * | 7/2009 | Sudo et al. | 2/69 |
| 2003/0028952 | A1 * | 2/2003 | Fujii et al. | 2/400 |
| 2003/0101506 | A1 * | 6/2003 | Fujii et al. | 2/240 |
| 2004/0107479 | A1 * | 6/2004 | Dicker et al. | 2/227 |
| 2004/0111781 | A1 * | 6/2004 | Miyake et al. | 2/69 |
| 2004/0255358 | A1 * | 12/2004 | Ota et al. | 2/69 |
| 2005/0086721 | A1 * | 4/2005 | Lambertz | 2/69 |
| 2005/0193461 | A1 * | 9/2005 | Caillibotte et al. | 2/69 |
| 2005/0239370 | A1 * | 10/2005 | Oyama et al. | 450/99 |
| 2005/0241044 | A1 * | 11/2005 | Zorica | 2/69 |
| 2006/0074365 | A1 * | 4/2006 | Brown | 602/24 |
| 2006/0130215 | A1 * | 6/2006 | Torry | 2/227 |
| 2006/0169004 | A1 * | 8/2006 | Belluye et al. | 66/177 |
| 2006/0277645 | A1 * | 12/2006 | Okajima | 2/69 |
| 2007/0033696 | A1 * | 2/2007 | Sellier | 2/69 |
| 2007/0067892 | A1 * | 3/2007 | Oyama et al. | 2/227 |
| 2007/0214541 | A1 * | 9/2007 | Kawasaki et al. | 2/69 |
| 2007/0256217 | A1 * | 11/2007 | Takamoto et al. | 2/401 |
| 2008/0083055 | A1 * | 4/2008 | Onda | 2/455 |
| 2008/0141430 | A1 * | 6/2008 | Rance et al. | 2/67 |
| 2009/0007311 | A1 * | 1/2009 | Semba et al. | 2/69 |

FOREIGN PATENT DOCUMENTS

| | | |
|---|---|---|
| JP | 2001-214303 | 8/2001 |
| JP | 3241608 | 10/2001 |
| JP | 2002-220708 | 8/2002 |
| JP | 2004-300619 | 10/2004 |

* cited by examiner

TIGHTS

TECHNICAL FIELD

The present invention relates to a pair of sports tights as outerwear and, more particularly, to a pair of tights capable of stably promoting instantaneous motions of a leg and of being comfortably worn for a long time.

BACKGROUND ART

A principal object of designing the basic construction of a pair of tights is to fit the tights to the human body in a stationary standing position, and incorporate functions to adapt to motions of the human body into the tights by adding allowances to the basic construction.

In the conventional pairs of tights, the elasticity of materials is very important and there is a tendency to rely easy on the ability of the material. Thus motion-adaptive functions are dealt with as secondary importance.

The pairs of tights of such basic construction are poorly motion-adaptive, and reaction forces of the stretched elastic materials exert pressure on the human body and often cause physical fatigue. Therefore, it is desirable to design motion-adaptive construction that will reduce reaction forces to the least possible extent when elastic materials are used.

The inventors of the present invention developed a pair of tights of motion-adaptive construction disclosed in Jpn. Pat. No. 3241608 (Patent document 1). The pair of tights proposed in Patent document 1 hold portions of the lower half body including the back side of the waist on which the legs move, the greater trochanters (hip joints), the flat ligaments running down along the lateral side of the thigh to the knee, the small collateral ligament extending between the thigh bone, and the lower leg bone and the functional chain of the ankle lateral by highly stretchable parts. The highly stretchable parts exert pressure on those portions of the human body every time the legs make a motion to support and stabilize axes of motions of the legs so that the legs are able to make well-balanced, efficient motions. The pair of tights will not compress the human body by excessively high pressure that will load muscles and can be comfortably worn for a long time.

SUMMARY OF THE INVENTION

It has been proved that the pair of tights proposed in Patent document 1 are effective in properly holding the human body for a middle-distance race and a long-distance race. However, the tights lack a function to pull up the knees when the legs repeat momentary actions during a short-distance race, lack an ability to assist the antagonism of an inner side-pressure on the knee against an outer side-pressure on the knee, and cannot suppress the subtle wobbling of the knees.

The inventors of the present invention analyzed the construction of the human body and, particularly, functions of the sartorius and the adductors. They found that the adductor divides obliquely a group of muscles longitudinally extending on the front and the outer side of the thigh, such as the femoral rectus, the vast lateral muscles and the flat ligaments running down along the lateral side of the thigh to the knee. The adductors take part of the functions of the groups of muscles and act in a considerably complicated mode on a leg lifting motion, and that the sartorius and the adductors are related with positioning the lifted knee.

Accordingly, it is an object of the present invention to solve problems in the prior art and to provide a pair of tights capable of suppressing deviation to stabilize running, and capable of being comfortably worn for a long time without causing significant fatigue.

The present invention provides a pair of tights including: front parts each having a lower end portion of a length including an allowance for compensating pressure that will be applied to the knee when the knee is bent and an upper end portion of a length shortened by a length corresponding to slack which will be present when the hip joint is turned and covering the waist, the knee and the front side of the ankle; back parts each having a lower end portion of a length shortened by slack corresponding to the back side of the knee and an upper end portion of a length increased by a length necessary for relaxing a stretched portion extending over a sulcus region in the haunches and the inner side of the thigh and stretched when the knee joint is bent, and covering a lower end part of the waist, the hip and the back side of the ankle; outer side parts each having a portion corresponding to the greater trochanter and curved convexly toward the back part and a portion corresponding to the outer side of the knee and curved convexly toward the front part, curved so as to meander gently and covering a side portion of the waist corresponding to the greater trochanter, the outer side of the knee joint and the outer side of the ankle; back waist projections each formed integrally with the outer side part and projecting from the upper end of the outer side part over the back side of the waist; inner side parts each having a portion corresponding to the inner side of the knee and curved convexly toward the front part, gently curved in an L-shape and covering the groin, the inner side of the thigh, the inner side of the knee and the inner side of the ankle; outer knee support parts each having a concave portion of a shape substantially corresponding to that of the knee and placed on the outer surfaces of the outer side part and the front part to support the outer side of the knee; inner knee support parts each having a concave portion of a shape substantially corresponding to that of the knee and placed on the outer surfaces of the inner side part and the front part to support the inner side of the knee; and sartorius and adductors support parts each covering the back side of the waist, the sartorius and the adductors, and extending to the upper end of the inner knee support part. The outer parts, the back waist projection, and the support parts are formed of a stretchable material having a high elastic modulus higher than that of a material forming the rest.

The present invention can promote an instantaneous pulling action to pull up the knee connected with the action of the hamstrings (bicepses femoris) to promote the forward thrusting of the thighs. The inward and outward deviation of the knees due to the tensioning and relaxation of the knees during a short-distance race can be prevented, the legs can be assisted for forward acceleration, and the tights can be very comfortably worn for a long time without causing fatigue that may result from compression.

REFERENCE CHARACTERS

Figure 1:
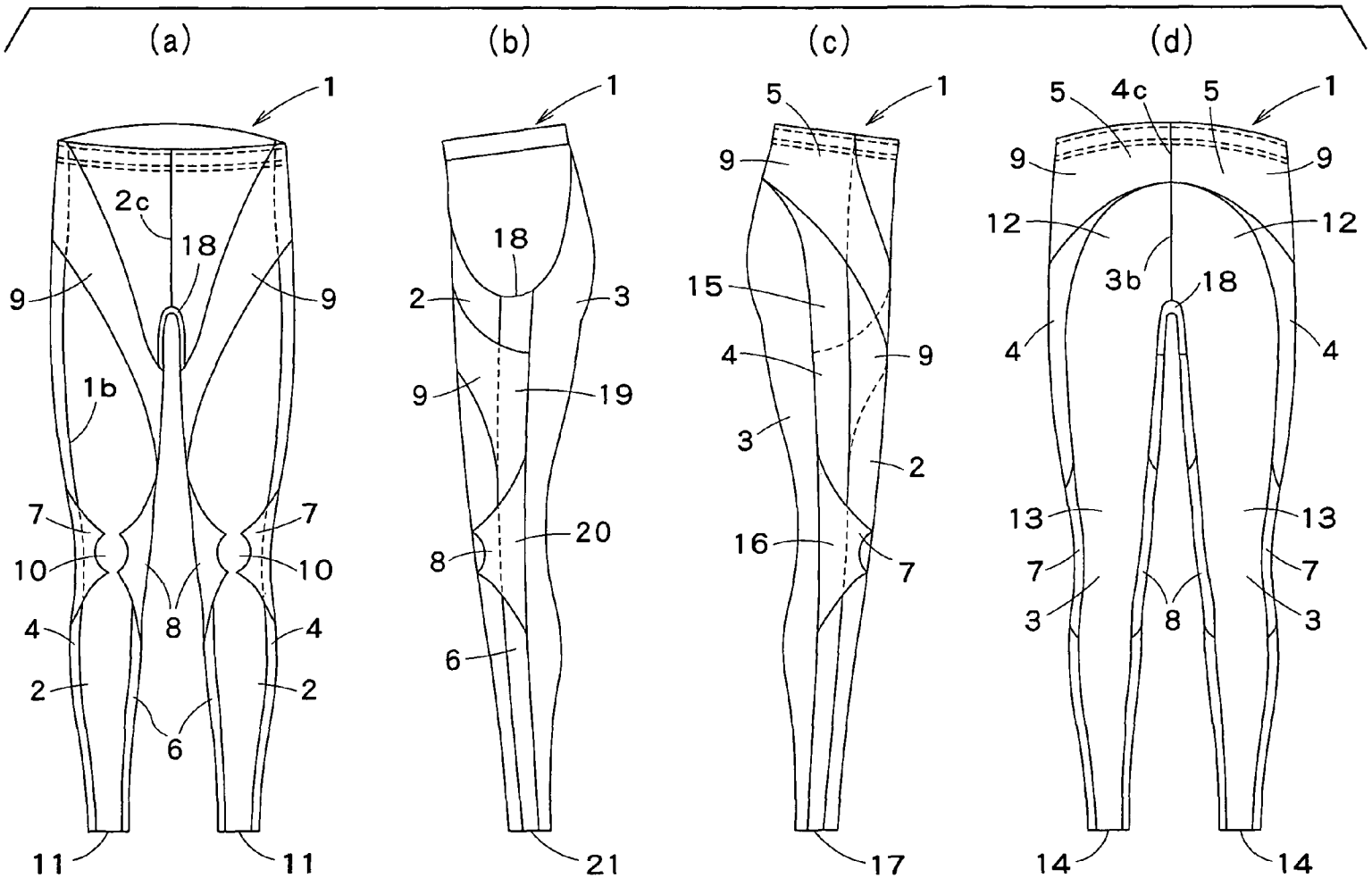
FIGS. 1(*a*), 1(*b*), 1(*c*) and 1(*d*) show a front elevation, a side elevation of a right inner side, a side elevation of a right outer side and a rear view, respectively, of a pair of tights in a preferred embodiment according to the present invention.

2 Front part
3 Back part
4 Outer side part
5 back waist projection
6 Inner side part
7 Outer knee support part
8 Inner knee support part
9 sartorius and adductor support part
10 Knee

DETAILED DESCRIPTION OF THE INVENTION

A pair of tights in a preferred embodiment according to the present invention will be described with reference to the accompanying drawings.

FIGS. 1(*a*) to 1(*d*) show the front, the right inner side, the right outer side and the back of tights 1 in a preferred embodiment according to the present invention, respectively.

Figure 2:
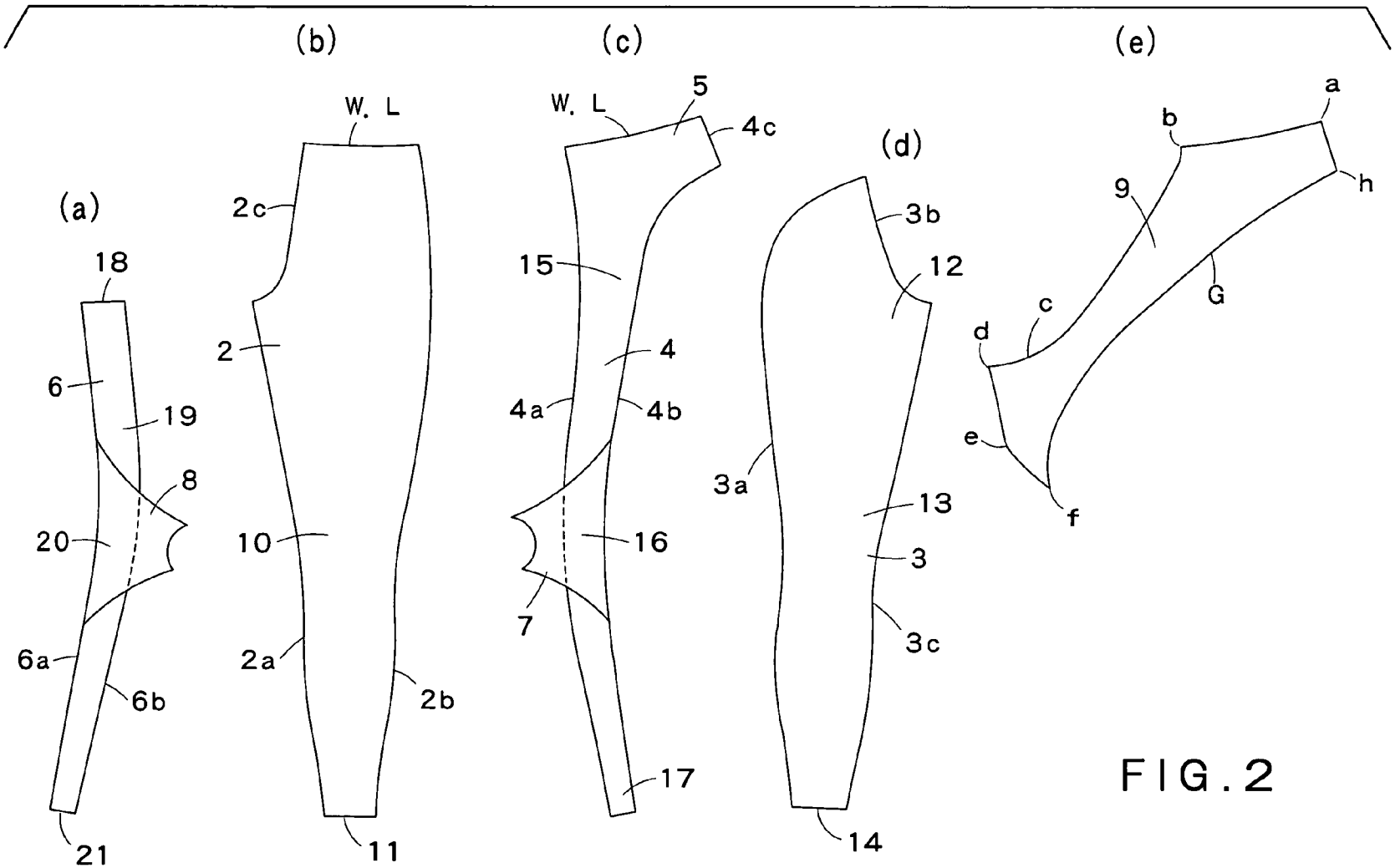
FIG. 2 is a plan view of parts forming the right half of the pair of tights shown in FIG. 1.

FIGS. 2(*a*) to 2(*e*) show separately a front part 2, a back part 3, a outer side part 4, a back waist projection 5, an inner side part 6, an outer knee support part 7, an inner knee support part 8 and a sartorius and adductor support part 9 of the tights 1.

The pair of tights 1 is completed by seaming together symmetrical halves each having the front part 2, the back part 3, the outer side part 4, the back waist projection 5, the inner side part 6, the outer knee support part 7, the inner knee support part 8 and the sartorius and adductor support part 9 shown in FIGS. 1 and 2.

Referring to FIGS. 1(*a*) and 2(*b*), the front part 2 covers a part of the body from the waist line WL down through the abdominal region and the knee 10 to the ankle's front side 11. Parts, near the knee 10, of a seaming edge 2*a* to be sewn to the inner side part 6 and a seaming edge 2*b* to be sewn to the outer side part 4 are enlarged vertically to reduce pressure that may be exerted on the knee when the knee joint is moved. A seaming edge 2*c* to be sewn to seaming edge 2*c* of the other front part 2 is shortened to take up slack produced in the front part 2 when the hip joint is moved.

Referring to FIGS. 1(*d*) and 2(*d*), the back part 3 covers a part of the body from the lower end of the waist down through the hip 12 and a popliteal part to ankle's back side 14. Parts, to the lower end of the hip, of a seaming edge 3*a* to be sewn to the outer side part 4 and a seaming edge 3*b* to be sewn to a seaming edge 3*b* of the other back part 3 are elongated to reduce pressure that may be exerted on a region around the hip 12 when the hip joint moves. Parts, near the popliteal part, of a seaming edge 3*a* to be sewn to the outer side part 4 and a seaming edge 3*c* to be sewn to the inner side part 6 are shortened to prevent the formation of folds in the back part 2 when the knee joint moves.

Referring to FIGS. 1(*c*) and 2(*c*), the outer side part 4 covers a part of the body from a side part of the waist near the waist line WL down through a region around the greater trochanter 15 of the hip joint and a knee's outer side 16 to the ankle's outer side 17. The outer side part 4 has a gently meandering shape having a part corresponding to the greater trochanter 15 and curved convexly toward the back part 3 and a part corresponding to the knee's outer side 16 and curved convexly toward the front part 2. A part, corresponding to a region around the greater trochanter 15, of a seaming edge 4*a* of the meandering outer side part 4 to be sewn to the front part 2 is formed in a short length to prevent the formation of folds in the front part 2 when the hip joint is moved. A part, corresponding to the knee's outer side part 16, of the outer side part 4 is formed in a long length to reduce pressure that may be exerted on the knee when the knee joint is moved.

A part, corresponding to a region around the greater trochanter 15, of the seaming edge 4*b* to be sewn to the back part 3 is formed in a long length to reduce pressure that may be exerted on the body when the hip joint is moved. A part, corresponding to a region around the knee's outer side 16, of the seaming edge 4*b* is formed in a short length to take up creases that may be formed in the popliteal part 13 of the back part 3 when the hip joint is moved.

As shown in FIGS. 1(*c*) and 2(*c*), the back waist projection 5 is an upper end part of the outer side part 4. The back waist projection covers a region between a part of the body corresponding to the upper end of the back part 3 and a part of the body corresponding to the waist line WL As shown in FIGS. 1(*b*) and 2(*a*), the inner side part 6 covers a region including the groin 18, the thigh's inside 19, the knee's inside 20 and the ankle's inner side 21. The inner side part 6 has a gently curved L-shape. A portion of the inner side part 6 corresponding to the knee's inner side 20 is curved convexly toward the front part 2. A part, corresponding to the knee's inner side 20, of a seaming edge 6*a* to be sewn to the back part 4 is formed in a short length to prevent the formation of folds in the back part 4 when the knee joint is moved. A part, corresponding to the knee's inner side 20, of a seaming edge 6*b* to be sewn to the front part 2 is formed in a long length to reduce pressure that may be exerted on the knee when the knee joint is moved.

An upper end part of the inner side part 6 is formed in a width corresponding to the fork of the body.

As shown in FIGS. 1(*c*) and 2(*c*), an outer knee support part 7 is placed on the outer surfaces of the outer side part 4 and the front part 2 and is sewn to the outer side part 4 and the front part 2. The outer knee support part 7 supports the knee's outer side 16. The outer knee support part 7 has a base edge coinciding with the seaming edge 4*b* of the outer side part 4, opposite oblique side edges curved convexly toward each other, and an end edge concavely curved in a shape substantially corresponding to the knee 10.

As shown in FIG. 1(*a*), the outer knee support parts 7 are separate from (not connected to) the inner knee support parts 8. The distance between the upper end of the concave end edge of the outer knee support part 7 and the upper end of the concave end edge of the inner knee support part 8 is about 20 mm. The distance between the lower end of the concave end edge of the outer knee support part 7 and the lower end of the concave end edge of the inner knee support part 8 is about 5 mm. The upper end of the concave end edge of the outer knee support part 7 and the upper end of the concave end edge of the inner knee support part 8 are spaced apart. The lower end of the concave end edge of the outer knee support part 7 and the lower end of the concave end edge of the inner knee support part 8 are spaced apart. Therefore, any excessive force will not be exerted on the knee joint when the knee joint is moved. Thus the outer knee support part 7 and the inner knee support part 8 cooperate to physically disperse and reduce tensions that act in all directions on a part covering the knee and bulged when the knee is bent and those acting in vertical directions. Thus the outer knee support part 7 and the inner knee support part 8 support the knee ligament.

As shown in FIGS. 1(*a*) to 1(*c*) and 2(*e*), the sartorius muscle and adductor support part 9 extends over the back side of the waist, the sartorius, the adductors and a region corresponding to the upper end of the inner side support 8. The sartorius and the adductors have a function to maintain a knee-up position The sartorius muscle has the shape of a long band having the widest part of about 4 cm in width. The sartorius muscle arises from the iliac spine of the pelvis and crosses the front of the thigh obliquely downward and extends through a back part of the inner side of the knee to the splint bone of the lower thigh. The iliac spine is firmly attached to the rough surface of the splint bone. When the thigh is thrust forward or the knee is turned outward in a cross-legged sitting position, the flat ligaments running down along the lateral side of the thigh to the knee lie on the outer side of the knee and press the knee inward. The sartorius muscle contends with the pressure of the flat ligaments running down along the lateral side of the thigh to the knee. Balance of the respective actions of the flat ligaments running down along the lateral side of the thigh to the knee and the sartorius muscle and the knee stretching function of the quadriceps keep the position of the knee in a dynamic state.

The adductor muscles include long adductors, short adductors and big adductors. Each of the adductor muscles extends from the pubic tuber of the pelvis and spreads gradually on the femoral line. Some of the big adductor muscles extend from the ischiatic tuber. Some of the big adductor muscles spread gradually on the inner femoral epicondyle. The adductors pull the thigh toward the median line of the body. For example, the adductors pull the thigh strongly when the leg is moved for a large motion by thrusting the thigh forward after the foot has separated from the ground during running.

As shown in FIG. 2(*e*), the sartorius and adductors support part 9 has an upper edge extending along the waist line WL between the back center a of the waist' line WL and a position b corresponding to the upper, anterior iliac spine, and extends obliquely downward from the position b over the front of the upper, anterior iliac spine, the upper edge of the sartorius and the adductors to points c and d on the inner side of the crotch, extends from the point d along a cut line to a position e corresponding to the back upper end of the inner knee support part 8 and extends from the position e along the upper end of the inner knee support part 8 to a position f.

Thus, the lower part of the sartorius and adductors support part 9 extends obliquely downward from a position h below the back center a along the lower edge of the sartorius on the front side, extends in a curve along a cutting line on the inner side of the tights to the position f and extends from the position f to the position e corresponding to the back upper end of the inner knee support part 8.

The length of the upper end between the positions a and b of the sartorius and adductors support part 9 is equal to the length along the waist line of the back waist projection 5 formed integrally with the outer side part 4. The length of the edge between the positions c and d of the sartorius and adductors support part 9 is equal to the width of the inner side part 6. The length of the edge between the positions d and e of the sartorius and adductors support part 9 is equal to the length of the inner knee support part 8 along the length of the inner side part 6 between the position d and the back upper end of the inner knee support part 8. The length of an edge between the positions a and h is equal to the length of the back waist projection 5 along a vertical direction. The length of an edge between a position g and the position h is equal to that of the lower edge of the back waist projection 5. The length of an edge between the positions f and g is equal to that of the length of the front part 2 along the lower edge of the sartorius.

Figure 3:
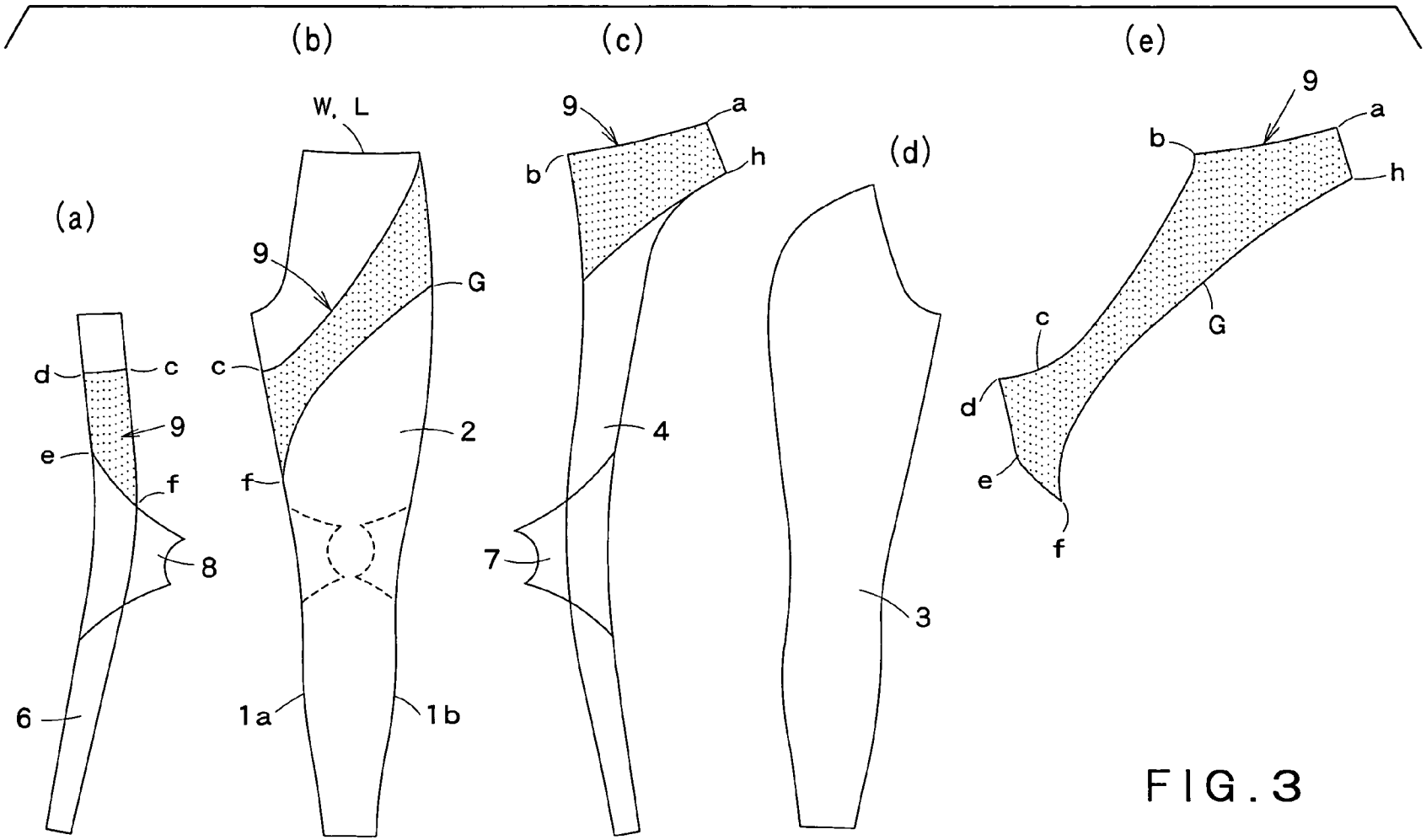
FIG. 3 is a plan view, similar to FIG. 2, showing muscle support strips respectively for supporting the sartorius and the adductors in the parts of the pair of tights.

As shown in FIGS. 3(*a*) to 3(*e*), the sartorius and adductors support part 9 overlaps the back waist projection 5 formed integrally with the outer side part 4 and a portion of the front part 2 corresponding to the sartorius and extends to the back upper end of the inner knee support part 8 (i.e., width of the lower end portion increases toward the upper end of the inner knee support part 8, as shown in FIGS. 1(*b*) and 2(*e*)).

The sartorius and adductors support part 9 extends from the center of the back along the waist line so as to cover the upper, anterior iliac spine, extends obliquely downward over the front of the upper, anterior iliac spine and the sartorius, and extends in a curve over the adductors to the upper end of the inner knee support part 8.

The outer side part 4 having the back waist projection 5, the outer knee support part 7, the inner knee support part 8 and the sartorius and adductors support part 9 of the pair of tights 1 of the present invention are formed of a strong stretchable material having a high elastic modulus higher than that of a material forming the front part 2, the back part 3 and the inner side part 6.

The respective seaming edges 2*a* and 2*b*, 3*a* and 3*b*, 4*a* and 4*b* and 5*a* and 5*b* of the front parts 2, the back parts 3, the outer side parts 4 each including the back waist projection 5 and the inner side parts 6 are sewn together to form halves of the tights 1. Then, the outer knee support part 7 and the inner knee support part 8 are sewn to each of the halves of the tights 1 so as to surround a portion corresponding to the knee 10. The sartorius and adductors support part 9 is extended over the back waist projection 5 of the outer side part 4 and a portion of the front part 2 corresponding to the sartorius to the upper back edge of the inner knee support part 8 of the inner side part 6 and is sewn to the back waist projection 5, the front part 2 and the inner side part 6. The respective seaming edges 2*c*, the seaming edges 3*b* and the seaming edges 4*c* of the halves of the tights 1 are sewn together to complete the pair of tights 1.

In the pair of tights 1 in the preferred embodiment, the front parts 2, the back parts 3 and the inner side parts 6 are made from 28-gage tricot fabrics formed by knitting 30 denier yarns containing 82% polyester filaments and 18% polyurethane filaments and having a basis weight of 250.0 g/m$^2$. The tricot fabrics have a longitudinal elongate of 163% and a lateral elongation of 152%. The outer side parts 4 integrally provided with the back waist projection 5, the outer knee support parts 7, the inner knee support parts 8 and the sartorius and adductors support parts 9 are made from 28-gage tricot fabrics having a high elastic modulus and formed by knitting 70 denier yarns containing 81% nylon filaments and 19% polyurethane filaments and having a basis weight of 315.0 g/m$^2$. These tricot fabrics have a longitudinal elongation of 111% and a lateral elongate of 110%. The elastic modulus of the tricot fabrics forming the outer side parts 4 and such is higher by 34% than that of the tricot fabrics forming the front part 2 and such.

The pair of tights 1 of the present invention is expected to be worn for a long time. Therefore, it is preferable that the stretchable material forming the front parts 2, the back parts 3 and the inner side parts 6 exerts a garment pressure of 30 kgf/cm$^2$ or below on the body, and the stretchable material having a high elastic modulus and forming the outer side parts 4 integrally provided with the back waist part 5, the outer knee support parts 7, the inner knee support parts 8 and the sartorius and adductors support parts 9 exerts a garment pressure of 40 kgf/cm$^2$ or above on the body.

The effects of the pair of tights 1 embodying the present invention will be described.

Figure 4:
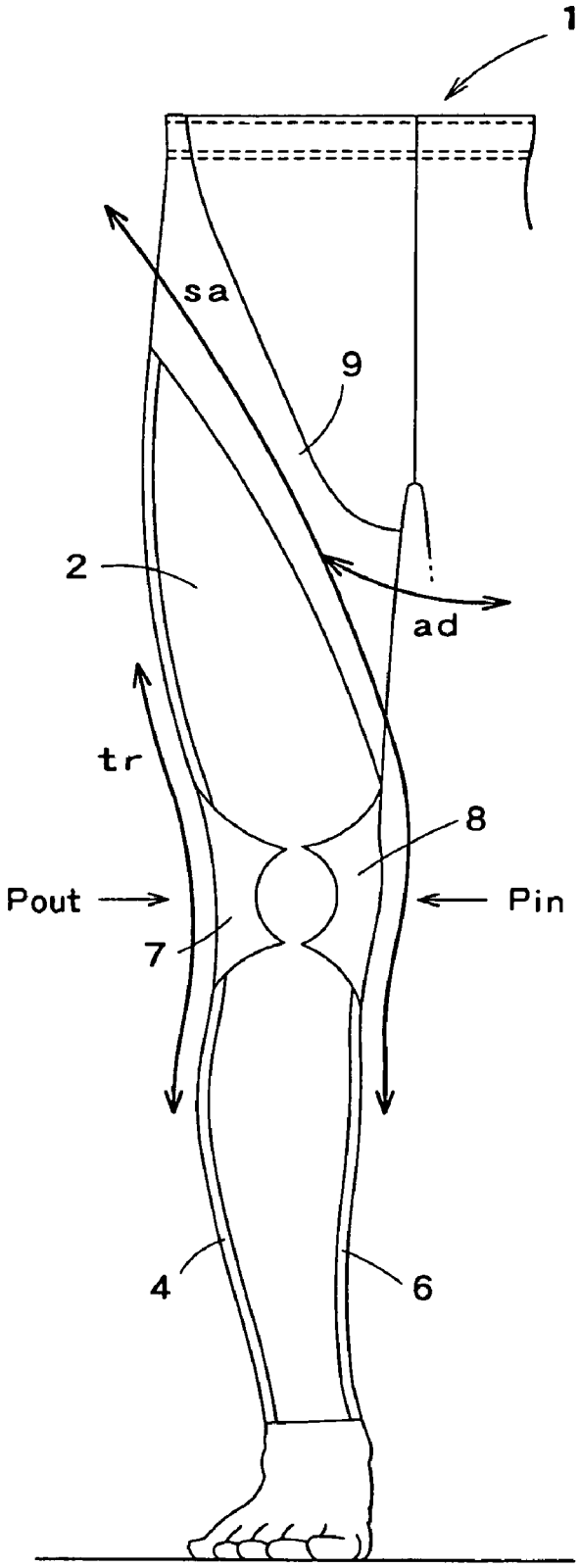
FIG. 4 is a front elevation of assistance in explaining antagonism of pressures exerted by a knee part of the pair of tights of the present invention.

Referring to FIG. 4, in the pair of tights 1, the sartorius and adductors support parts 9, formed of the material having a high elastic modulus, cover regions including the sartorius and the adductors and extending to the upper ends of the inner support parts 8, and the outer knee support parts 7 and the inner knee support parts 8 formed of the material having a high elastic modulus surrounds the knee 10. Therefore, tensions are applied to the flat ligaments tr running down along the lateral side of the thigh to the knee, the sartorius sa and the adductors ad in the directions of the arrows shown in FIG. 4. Consequently, an outer side-pressure $P_{out}$ applied to the knee by the flat ligaments tr and an inner side-pressure $P_{in}$ applied to the knee by the sartorius sa and the adductors ad contend with each other.

The sartorius and adductors support parts 9 are supported on the base fabric extending from the back waist, extend so as to cover the sartorius sa to the inner sides of the knees and pull the sartorius sa toward the inner sides of the thighs like the adductors ad. Thus the sartorius and adductor support parts 9 can be stably extended to the inner sides of the knees and can contend with the outer side-pressure $P_{out}$ applied to the knee by the flat ligaments tr.

The pair of tights 1 of the present invention maintains antagonism between the outer side-pressure $P_{out}$ produced by the flat ligaments tr and the inner side-pressure $P_{in}$ produced by the sartorius sa to restrain the knee from lateral wobbling while the legs are in motion. Consequently, the knees can be stably, efficiently and smoothly pulled forward and upward.

The invention claimed is:

1. A pair of tights comprising:

front parts for covering a waist, a knee, and a front side of an ankle, each of the front parts having:

a lower end portion with a length increased by an allowance amount of length for compensating for pressure to be applied to the knee when the knee is bent; and an upper end portion with a length shortened by a length corresponding to an amount of slack to be produced when a hip joint is turned;

back parts for covering a lower end part of the waist, a hip, and a back side of the ankle, each of the back parts having:

a lower end portion with a length shortened by a length of slack corresponding to a back side of the knee; and an upper end portion with a length increased by a length necessary for relaxing a stretched portion extending over a sulcus region in haunches and an inner side of a thigh, and stretching when the knee joint is bent;

outer side parts each curved so as to meander gently and cover a side portion of the waist corresponding to a greater trochanter, an outer side of the knee joint, and an outer side of the ankle, each of the outer side parts having:

a portion corresponding to the greater trochanter and being curved convexly toward a respective one of the back parts; and a portion corresponding to an outer side of the knee and curved convexly toward the front part;

back waist projections each formed integrally with a respective one of the outer side parts and projecting from an upper end of the respective one of the outer side parts over a back side of the waist;

inner side parts each gently curved in an L-shape and covering a groin area, an inner side of the thigh, an inner side of the knee, and an inner side of the ankle, each of the inner side parts having a portion corresponding to the inner side of the knee and curved convexly toward the front part;

outer knee support parts each being located on an outer surface of a respective one of the outer side parts and the front parts to support an outer side of the knee, each of the outer knee support parts having a concave portion with a shape substantially corresponding to a shape of the knee;

inner knee support parts each being located on an outer surface of a respective one of the inner side parts and the front parts to support an inner side of the knee, each of the inner knee support parts having a concave portion with a shape substantially corresponding to a shape of the knee, the inner knee support parts being separate from and not directly connected to the outer knee support parts; and sartorius and adductor support parts each covering the back side of the waist, a sartorius muscle, and adductor muscles, each of the sartorius and adductor support parts having a first end portion connected to a respective one of the back waist projections and a second end portion connected to a respective one of the inner knee support parts and a respective one of the inner side parts such that each of the sartorius and adductor support parts extends from the back side of the waist to an upper end of the respective one of the inner knee support parts, each of the satorius and adductor support parts being shaped such that a width of the second end portion increases closer to the upper end of the respective one of the inner knee support parts;

wherein the first end portion of a right-side one of the sartorius and adductor support parts and the first end portion of a left-side one of the sartorius and adductor support parts are connected together at a center of the back side of the waist such that the sartorius and adductor support parts extend symmetrically from the center of the back side of the waist; and wherein the outer side parts, the back waist projections, the outer knee support parts, the inner knee support parts, and the sartorius and adductor support parts are formed of a stretchable material having an elastic modulus higher than an elastic modulus of a material forming the front parts, the back parts, and the inner side parts.

2. The pair of tights according to claim 1, wherein the first end portion of each of the sartorius and adductor support parts overlaps a respective one of the back waist projections.

3. The pair of tights according to claim 1, wherein the second end portion of the right-side one of the sartorius and adductor support parts and the second end portion of the left-side one of the sartorius and adductor support parts delineate a downwardly curved line extending from the back side of the waist.

4. The pair of tights according to claim 1, wherein each of the sartorius and adductor support parts extends from the back side of the waist to an upper end of the respective one of the inner knee support parts with intersecting another support part.

5. The pair of tights according to claim 1, wherein each of the sartorius and adductor support parts comprises only a single, undivided band of material extending from the back side of the waist to an upper end of the respective one of the inner knee support parts.

* * * * *